United States Patent [19]

Harrison et al.

[11] Patent Number: 4,740,497

[45] Date of Patent: Apr. 26, 1988

[54] POLYMERIC MIXTURE FOR DYE-RECEIVING ELEMENT USED IN THERMAL DYE TRANSFER

[75] Inventors: Daniel J. Harrison, Rochester; Wayne A. Bowman, Walworth, both of N.Y.

[73] Assignee: Eastman Kodak Company, Rochester, N.Y.

[21] Appl. No.: 925,950

[22] Filed: Nov. 3, 1986

Related U.S. Application Data

[63] Continuation-in-part of Ser. No. 813,293, Dec. 24, 1985, abandoned.

[51] Int. Cl.[4] ..... B41M 5/26

[52] U.S. Cl. ..... 503/227; 8/471; 427/256; 428/195; 428/412; 428/480; 428/483; 428/500; 428/522; 428/523; 428/913; 428/914

[58] Field of Search ..... 8/470, 471; 346/227; 428/195, 913, 914, 412, 480, 483, 500, 522, 523; 427/256; 430/945; 503/227

[56] References Cited

U.S. PATENT DOCUMENTS

| | | | |
|---|---|---|---|
| 3,935,337 | 1/1976 | Taylor | 427/180 |
| 3,965,021 | 6/1976 | Clemens et al. | 525/72 |
| 4,080,354 | 3/1978 | Kramer | 523/522 |
| 4,326,010 | 4/1982 | Bauer | 428/480 |
| 4,657,971 | 4/1987 | Shiraki et al. | 525/64 |

FOREIGN PATENT DOCUMENTS

| | | | |
|---|---|---|---|
| 19138 | 1/1985 | Japan | 503/227 |

*Primary Examiner*—Bruce H. Hess
*Attorney, Agent, or Firm*—Harold E. Cole

[57] ABSTRACT

A dye-receiving element for thermal dye transfer comprises a support having thereon a mixture of poly(caprolactone) or a linear aliphatic polyester with one or both of poly(styrene-co-acrylonitile) and a bisphenol A polycarbonate. Dyes which are transferred to this receiving element have improved light stability.

21 Claims, No Drawings

POLYMERIC MIXTURE FOR DYE-RECEIVING ELEMENT USED IN THERMAL DYE TRANSFER

This application is a continuation-in-part of U.S. Application Ser. No. 813,293, filed Dec. 24, 1985, now abandoned.

This invention relates to dye-receiving elements used in thermal dye transfer, and more particularly to the use of a certain polymeric mixture as the dye image-receiving layer.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Ser. No. 778,960 by Brownstein entitled "Apparatus and Method For Controlling A Thermal Printer Apparatus," filed Sept. 23, 1985, the disclosure of which is hereby incorporated by reference.

In Japanese laid open publication number 19,138/85, an image-receiving element for thermal dye transfer printing is disclosed. The dye image-receiving layer disclosed comprises a polycarbonate containing a plasticizer. Such dye image-receiving layers have certain desirable properties such as good dye uptake and little surface deformation when heated by a thermal printing head.

There is a problem with polycarbonate dye image-receiving layers, however, in that dyes which are transferred to such layers exhibit poor light stability. A particularly severe dye fade problem is observed in neutral areas where yellow, magenta and cyan are combined to form a neutral (gray-black) image.

It would be desirable to improve the light stability of dyes which are transferred to a polycarbonate dye image-receiving layer.

In accordance with this invention, a dye-receiving element for thermal dye transfer is provided which comprises a support having thereon a dye image-receiving layer comprising a mixture of poly(caprolactone) or a linear aliphatic polyester with one or both of poly(styrene-co-acrylonitrile) and a bisphenol A polycarbonate.

The poly(caprolactone) or linear aliphatic polyester may be present in any concentration which is effective for the intended purpose. In a preferred embodiment of the invention, the poly(caprolactone) or linear aliphatic polyester is present from about 20 to about 60% of the mixture by weight.

In another preferred embodiment of the invention, the poly(caprolactone) comprises recurring units having the formula:

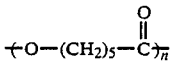

wherein n is from about 100 to about 600.

Any linear polyester may be employed in the invention as long as it is aliphatic. Aromatic polyesters were found to be too insoluble for practical coating. Suitable linear aliphatic polyesters useful in the invention include the following: poly(1,4-butylene adipate); poly(hexamethylene sebacate); poly(1,4-butylene sebacate); poly(hexamethylene adipate); poly(hexamethylene azelate); and poly(octamethylene glutarate). In a preferred embodiment, poly(1,4-butylene adipate) and poly(hexamethylene sebacate) are employed.

The weight ratio of monomers used in the poly(styrene-co-acrylonitrile) employed in the invention can vary over a wide range. In general, good results have been obtained when the styrene monomer is present from about 60 to about 80% by weight.

In another preferred embodiment of the invention, the bisphenol A polycarbonate comprises recurring units having the formula:

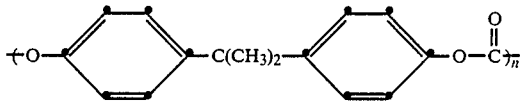

wherein n is from about 100 to about 500.

The polymers of the dye image-receiving layer may be present in any amount which is effective for the intended purpose. In general, good results have been obtained at a total concentration of from about 1 to about 5 g/m$^2$. It may be solvent coated from a variety of solvents such as dichloromethane, 2-butanone or tetrahydrofuran.

Blending of a polycarbonate resin with poly(caprolactone) or a linear aliphatic polyester has been found to give improved light stability for dyes transferred to it. Poly(styrene-co-acrylonitrile) used alone as a receiver gives poor dye light stability, but blending with poly(caprolactone) or a linear aliphatic polyester provides significant improvement. Good results are also obtained with a ternary mixture of these polymers.

The support for the dye-receiving element may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek®. In a preferred embodiment, polyester with a white pigment incorporated therein is employed.

A dye-donor element that is used with the dye-receiving element of the invention comprises a support having thereon a dye layer. Any dye can be used in such a layer provided it is transferable to the dye image-receiving layer of the dye-receiving element of the invention by the action of heat. Especially good results have been obtained with sublimable dyes. Examples of sublimable dyes include anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

(magenta)

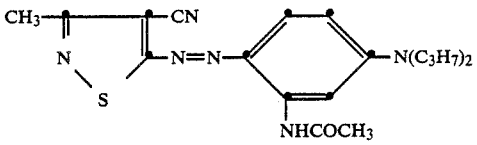

(yellow)

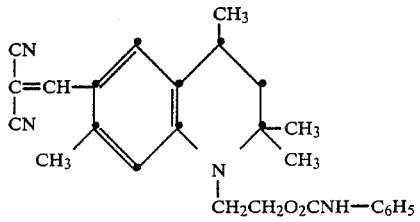

(cyan)

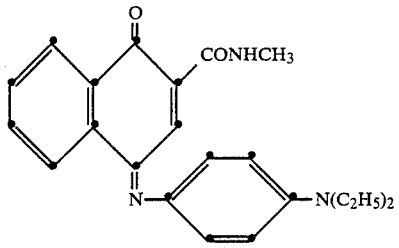

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

A dye-barrier layer comprising a hydrophilic polymer may also be employed in the dye-donor element between its support and the dye layer which provides improved dye transfer densities.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

As noted above, dye-donor elements are used to form a dye transfer image. Such a process comprises image-wise-heating a dye-donor element and transferring a dye image to a dye-receiving element as described above to form the dye transfer image.

The dye-donor element employed in certain embodiments of the invention may be used in sheet form or in a continuous roll or ribbon. If a continuous roll or ribbon is employed, it may have only one dye thereon or may have alternating areas of different dyes, such as cyan, magenta, yellow, black, etc., as disclosed in U.S. Pat. No. 4,451,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements employed in the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

(A) A yellow dye-donor element was prepared by coating the following layers in the order recited on a 6 μm poly(ethylene terephthalate) support:

(1) Dye-barrier layer of gelatin nitrate (gelatin, cellulose nitrate and salicyclic acid in approximately 20:5:2 weight ratio in a solvent of acetone, methanol and water) (0.17 g/m$^2$), (2) Dye layer containing the following yellow dye (0.39 g/m$^2$) in cellulose acetate (40% acetyl) (0.38 g/m$^2$) coated from 2-butanone, acetone and cyclohexanone (14:8:1) solvent:

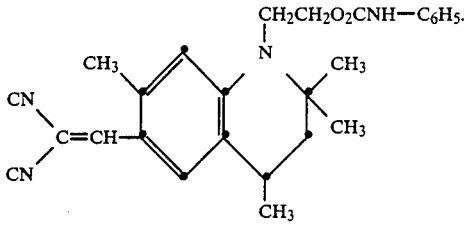

On the back side of the element, a slipping layer of poly(vinyl stearate) (0.3 g/m$^2$) in polyvinylbutyral (Butvar-76 ® Monsanto) (0.45 g/m$^2$) was coated from tetrahydrofuran solvent.

(B) A magenta dye-donor element was prepared similar to (A) except that the dye layer (2) comprised the following magenta dye (0.22 g/m$^2$) in cellulose acetate hydrogen phthalate (0.38 g/m$^2$) coated from 2-butanone, acetone and cyclohexanone (14:4:1) solvent:

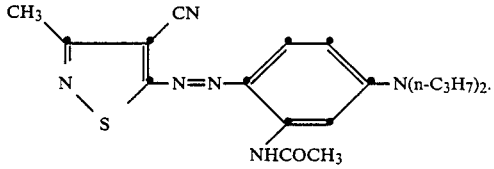

(C) A cyan dye-donor element was prepared similar to (A) except that the dye layer (2) comprised the following cyan dye (0.37 g/m$^2$) in cellulose acetate hydrogen phthalate (0.42 g/m$^2$) coated from 2-butanone, acetone and cyclohexanone (14:4:1) solvent:

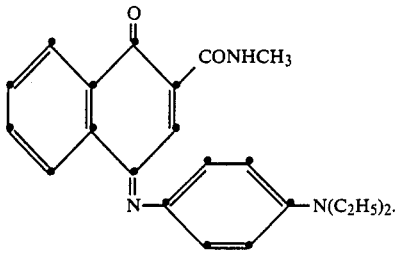

(D) A neutral dye-donor element was prepared similar to (A) except that dye layer (2) comprised a mixture of the above cyan dye (0.34 g/m$^2$), the above yellow dye (0.22 g/m$^2$) and the above magenta dye (0.15 g/m$^2$) in cellulose acetate hydrogen phthalate (0.49 g/m$^2$) coated from 2-butanone, acetone and cyclohexanone (14:4:1).

Dye receiving elements were prepared by coating polymer mixtures of the following components in the weight ratio shown in Table 1 from dichloromethane solvent at a constant coverage of 3.2 g/m$^2$ on top of an ICI Melinex ® "White Polyester" reflective support:

A. bisphenol A polycarbonate (b-Ap)

Bayer AG
Makrolon 5705 ®
Polycarbonate

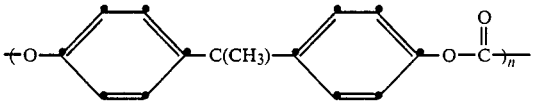

n=about 100 to about 500.

B. Poly(styrene-co-acrylonitrile) (60:40 wt. ratio) (SA)

C. Polycaprolactone (PC) Union Carbide Tone PCL-700 ®

The dye side of each dye-donor element strip 0.75 inches (19 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a Fujitsu Thermal Head (FTP-040MCS001) and was pressed with a spring at a force of 3.5 pounds (1.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were heated at 0.5 msec increments from 0 to 4.5 msec to generate a graduated density test pattern. The voltage supplied to the print head was approximately 19 v representing approximately 1.75 watts/dot. Estimated head temperature was 250°–400° C.

Four "records" were made from each dye set. Three incremental graduated density monochrome "records" were obtained from each individual yellow, magenta or cyan dye-donor. A "neutral" graduated density "record" was also obtained by using the dye-donor containing all three dyes.

The dye-receiver was separated from each of the dye donors and the Status A reflection densities of each monochrome and the neutral were read. Each sample was then subjected to "HID fading", 4 days, 50 kLux, 5400°, 32° C., approximately 25% RH. The Status A density loss from an approximate initial density of 1.2 for the monochromes or 0.9 for the neutrals was calculated. The following results were obtained:

TABLE 1

| Polymer Blend | Status A Density Loss (%) | | | | | |
|---|---|---|---|---|---|---|
| | Monochrome | | | Neutral | | |
| (b-Ap/SA/PC) | B | G | R | B | G | R |
| 100/0/0 (control) | −23 | −14 | −13 | −29 | −25 | −51 |
| 0/100/0 (control) | −22 | −16 | −12 | −25 | −20 | −52 |
| 75/0/25 | −20 | −10 | −9 | −20 | −12 | −42 |
| 50/0/50 | −12 | −1 | −13 | −11 | +2 | −25 |
| 0/50/50 | −8 | +6 | −10 | 0 | +3 | −15 |
| 25/50/25 | −25 | −10 | −16 | −21 | −15 | −47 |
| 43/15/43 | −10 | +1 | −12 | −7 | 0 | −21 |
| 25/25/50 | −8 | +6 | −10 | 0 | +3 | −15 |

The results indicate that as the percent of poly(caprolactone) (PC) in the polymer blend is increased above about 25%, a greater reduction in fade is observed. Blends of 50/50 b-Ap/PC showed significant improvements in cyan and yellow dye fade, while the 50/50 SA/PC blend showed even greater reduction in fade for all three colors. Ternary blends of all three polymers were similar to the SA/PC blend.

EXAMPLE 2

A neutral dye-donor element was prepared as in Example 1.

Dye receiving elements were prepared by coating polymer mixtures of the following components in the weight range shown in Table 2 from a methylene chloride and trichloroethylene solvent mixture at a constant coverage of 3.2 g/m$^2$ on top of an ICI Melinex® "White Polyester" reflective support:

A. bisphenol A polycarbonate (b-Ap)

Bayer AG
Makrolon 5705 ®
Polycarbonate

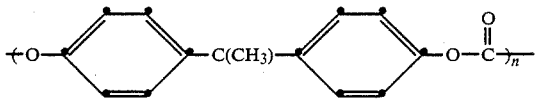

n=about 100 to about 500.

B. Poly(1,4-butylene adipate) (PBA)

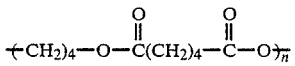

C. Poly(hexamethylene sebacate) (PHS)

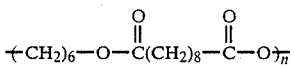

D. Aromatic polyester of poly(ethylene-(5-carboxy-1,3,3-trimethylindane-1-(phenyl-4-carboxylate))) (P-2) (Control)

The elements were then processed as in Example 1. The red, green and blue status A reflection densities were read before and after the fading test. The percent density losses from maximum density were calculated as follows:

TABLE 2

| Polymer Blend | Status A Density Loss (%) Neutral | | |
|---|---|---|---|
| (b-Ap/PBA/PHS/P-2) | Red | Green | Blue |
| 100/0/0/0 (control) | −41 | −9 | −12 |
| 90/0/0/10 (control) | −43 | −11 | −13 |
| 75/0/0/25 (control) | −47 | −13 | −16 |
| 50/0/0/50 (control) | −50 | −15 | −16 |
| 90/10/0/0 | −39 | −8 | −11 |
| 75/25/0/0 | −40 | −9 | −13 |
| 62.5/37.5/0/0 | −31 | −6 | −10 |
| 90/0/10/0 | −37 | −7 | −10 |
| 75/0/25/0 | −28 | −5 | −9 |
| 62.5/0/37.5/0 | −21 | −4 | −8 |
| 50/0/50/0 | −20 | −3 | −7 |

The results indicate that blends of a linear aliphatic polyester with a polycarbonate used as dye-receivers give superior stability to light fading compared to the use of a polycarbonate alone. The addition of a linear aromatic polyester, however, gave a poorer stability to light fading.

The invention has been described in detail with particular reference to preferred embodiments thereof, but it will be understood that variations and modifications can be effected within the spirit and scope of the invention.

What is claimed is:

1. A dye-receiving element comprising a support having thereon a thermally-transferred dye image in a dye image-receiving layer comprising a mixture of poly(caprolactone) or a linear aliphatic polyester with one or both of poly(styrene-co-acrylonitrile) and a bisphenol A polycarbonate.

2. The element of claim 1 wherein said poly(caprolactone) or said linear aliphatic polyester is present from about 20 to about 60% of the mixture by weight.

3. The element of claim 1 wherein said poly(caprolactone) comprises recurring units having the formula:

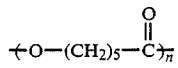

wherein n is from about 100 to about 600.

4. The element of claim 1 wherein said linear aliphatic polyester is poly(1,4-butylene adipate) or poly(hexamethylene sebacate).

5. The element of claim 1 wherein said poly(styrene-co-acrylonitrile) has the styrene monomer present from about 60 to about 80% by weight.

6. The element of claim 1 wherein said bisphenol A polycarbonate comprises recurring units having the formula:

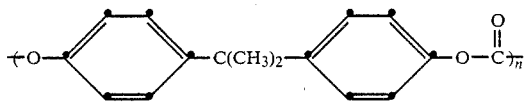

wherein n is from about 100 to about 500.

7. The element of claim 1 wherein said dye image-receiving layer comprises a mixture of about 20 to about 60% by weight of poly(caprolactone) with one or both of poly(styrene-co-acrylonitrile) and a bisphenol A polycarbonate.

8. The element of claim 1 wherein said dye image-receiving layer comprises a mixture of about 20 to about 60% by weight of poly(1,4-butylene adipate) or poly(-hexamethylene sebacate) with a bisphenol A polycarbonate.

9. The element of claim 1 wherein said support comprises a polyester with a white pigment incorporated therein.

10. In a process of forming a dye transfer image comprising imagewise-heating a dye-donor element comprising a support having thereon a dye layer and transferring a dye image to a dye-receiving element to form said dye transfer image, said dye-receiving element comprising a support having therein a dye image-receiving layer, the improvement wherein said dye image-receiving layer comprises a mixture of poly(caprolactone) or a linear aliphatic polyester with one or both of poly(styrene-co-acrylonitrile) and a bisphenol A polycarbonate.

11. The process of claim 10 wherein said poly(caprolactone) or said linear aliphatic polyester is present from about 20 to about 60% of the mixture by weight.

12. The process of claim 10 wherein the support for the dye-donor element comprises poly(ethylene terephthalate) which is coated with sequential repeating areas of cyan, magenta and yellow dye, and said process steps are sequentially performed for each color to obtain a three-color dye transfer image.

13. In a thermal dye transfer assemblage comprising:

(a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer, the improvement wherein said dye image-receiving layer comprises a mixture of poly(caprolactone) or a linear aliphatic polyester with one or both of poly(styrene-co-acrylonitrile) and a bisphenol A polycarbonate.

14. The assemblage of claim 13 wherein said poly(caprolactone) or said linear aliphatic polyester is present from about 20 to about 60% of the mixture by weight.

15. The assemblage of claim 13 wherein said poly(caprolactone) comprises recurring units having the formula:

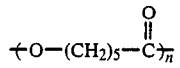

wherein n is from about 100 to about 600.

16. The assemblage of claim 13 wherein said linear aliphatic polyester is poly(1,4-butylene adipate) or poly(hexamethylene sebacate).

17. The assemblage of claim 13 wherein said poly(styrene-co-acrylonitrile) has the styrene monomer present from about 60 to about 80% by weight.

18. The assemblage of claim 13 wherein said bisphenol A polycarbonate comprises recurring units having the formula:

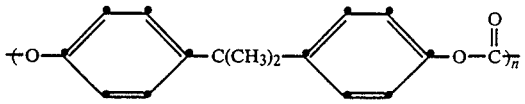

wherein n is from about 100 to about 500.

19. The assemblage of claim 13 wherein said dye image-receiving layer comprises a mixture of about 20 to about 60% by weight of poly(caprolactone) with one or both of poly(styrene-co-acrylonitrile) and a bisphenol A polycarbonate.

20. The assemblage of claim 13 wherein said dye image-receiving layer comprises a mixture of about 20 to about 60% by weight of poly(1,4-butylene adipate) or poly(hexamethylene sebacate) with a bisphenol A polycarbonate.

21. The assemblage of claim 13 wherein said support of the dye-receiving element comprises a polyester with a white pigment incorporated therein.

* * * * *